US010837408B2

(12) United States Patent
Ecker et al.

(10) Patent No.: US 10,837,408 B2
(45) Date of Patent: Nov. 17, 2020

(54) FUEL METERING FOR THE OPERATION OF AN INTERNAL COMBUSTION ENGINE

(71) Applicant: Robert Bosch GmbH, Stuttgart (DE)

(72) Inventors: Rainer Ecker, Kornwestheim (DE); Thomas Kuhn, Heibronn (DE); Timm Hollmann, Benningen A.n. (DE); Udo Schulz, Vaihingen/Enz (DE)

(73) Assignee: Robert Bosch GmbH, Stuttgart (DE)

( * ) Notice: Subject to any disclaimer, the term of this patent is extended or adjusted under 35 U.S.C. 154(b) by 2 days.

(21) Appl. No.: 15/781,669

(22) PCT Filed: Nov. 28, 2016

(86) PCT No.: PCT/EP2016/078947

§ 371 (c)(1),
(2) Date: Jun. 5, 2018

(87) PCT Pub. No.: WO2017/097614

PCT Pub. Date: Jun. 15, 2017

(65) Prior Publication Data

US 2018/0274489 A1 Sep. 27, 2018

(30) Foreign Application Priority Data

Dec. 7, 2015 (DE) ..... 10 2015 224 402

(51) Int. Cl.
*F02M 25/022* (2006.01)
*F02D 41/30* (2006.01)
(Continued)

(52) U.S. Cl.
CPC ..... *F02M 25/0227* (2013.01); *F02B 47/02* (2013.01); *F02D 19/12* (2013.01);
(Continued)

(58) Field of Classification Search
CPC ..... F02M 25/0221; F02M 25/0225; F02M 25/0227; F02M 25/028; F02M 25/0228;
(Continued)

(56) References Cited

U.S. PATENT DOCUMENTS 10,337,461 B2 * 7/2019 Kluth ..... F02D 41/22
2006/0096572 A1 5/2006 Satou et al.
(Continued)

FOREIGN PATENT DOCUMENTS

CN 101963115 A 2/2011
EP 0586891 A1 3/1994
(Continued)

OTHER PUBLICATIONS

English Machine Translation of JP-05312117-A provided by JPLAT (Year: 2020).*
(Continued)

*Primary Examiner* — Jacob M Amick
*Assistant Examiner* — Michael A Kessler
(74) *Attorney, Agent, or Firm* — Norton Rose Fulbright US LLP; Gerard Messina

(57) ABSTRACT

For an optimized metering of fuel and water for the operation of an internal combustion engine in which a direct injection and an intake manifold injection are provided for metering fuel into the internal combustion engine, and in which the internal combustion engine is assigned a system for water injection, a same intake manifold injector is used for both water and fuel injection.

21 Claims, 4 Drawing Sheets

(51) Int. Cl.

| | |
|---|---|
| ***F02D 41/00*** | (2006.01) |
| ***F02M 25/028*** | (2006.01) |
| ***F02D 19/12*** | (2006.01) |
| ***F02B 47/02*** | (2006.01) |
| ***F02M 43/00*** | (2006.01) |
| ***F02M 63/02*** | (2006.01) |
| ***F02M 69/04*** | (2006.01) |
| ***F02M 69/46*** | (2006.01) |
| ***F02M 35/10*** | (2006.01) |

(52) U.S. Cl.
CPC ..... *F02D 41/0025* (2013.01); *F02D 41/3094* (2013.01); *F02M 25/028* (2013.01); *F02M 25/0221* (2013.01); *F02M 35/10216* (2013.01); *F02M 43/00* (2013.01); *F02M 63/029* (2013.01); *F02M 69/046* (2013.01); *F02M 69/465* (2013.01)

(58) Field of Classification Search
CPC ..... F02M 25/03; F02M 35/10216; F02M 69/046; F02B 47/02; F02D 19/12; F02D 41/0025; F02D 41/3094; Y02T 10/121
USPC ..... 123/25 A, 431, 575
See application file for complete search history.

(56) References Cited

U.S. PATENT DOCUMENTS

| | | | | |
|---|---|---|---|---|
| 2007/0119392 | A1* | 5/2007 | Leone | F01N 11/00 123/25 C |
| 2017/0107950 | A1* | 4/2017 | Hoegl | F02B 47/02 |
| 2019/0178154 | A1* | 6/2019 | Park | F02M 25/028 |
| 2019/0291666 | A1* | 9/2019 | Martin | F02N 99/00 |

FOREIGN PATENT DOCUMENTS

| | | | | |
|---|---|---|---|---|
| EP | 2700804 | A1 | 2/2014 | |
| EP | 2789839 | A2 | 10/2014 | |
| EP | 2918813 | A1 | 9/2015 | |
| EP | 2789839 | B1 * | 7/2016 | F02M 69/046 |
| JP | 05312117 | A * | 11/1993 | |
| JP | 2000179368 | A | 6/2000 | |

OTHER PUBLICATIONS

International Search Report dated Feb. 10, 2017 of the corresponding International Application PCT/EP2016/078947 filed Nov. 28, 2016.

* cited by examiner

FUEL METERING FOR THE OPERATION OF AN INTERNAL COMBUSTION ENGINE

CROSS-REFERENCE TO RELATED APPLICATIONS

The present application is the national stage of International Pat. App. No. PCT/EP2016/078947 filed Nov. 28, 2016, and claims priority under 35 U.S.C. § 119 to DE 10 2015 224 402.4, filed in the Federal Republic of Germany on Dec. 7, 2015, the content of each of which are incorporated herein by reference in their entireties.

BACKGROUND

Operating an internal combustion engine using intake manifold fuel injection and gasoline direct injection allows for the particular advantages of both types of injection to be used for an optimized mixture formation, the combustion resulting therefrom, and thus a reduction of fuel consumption. The gasoline direct injection system is in particular more advantageous under full-load conditions and in the case of an increased dynamic of the internal combustion engine, since a reduced knocking tendency occurs in this case, for example. The intake manifold fuel injection is in particular more advantageous in the partial load range, since the number of particles, in particular soot particles, as well as the quantity of developing hydrocarbons is lower during combustion.

Another optimization of the mixture formation and combustion can be achieved by water injection. Here, distilled water is injected into the combustion air, for example in the intake system of the internal combustion engine. In principle, it is also possible to inject water directly into the cylinders via the injectors provided for this purpose. The injected and evaporated fluid has a cooling effect and reduces the compression work. Moreover, the water injection can decrease the exhaust emission, in particular that of nitrogen oxides.

If water is injected into the air intake system, an effective charge air cooling and thereby a cooling of the engine interior results from the energy necessary for the evaporation. The result of the colder and thus higher density of the combustion gases is a performance increase. Furthermore, the ignition can take place earlier in the case of high engine loads, since the cooler fuel/water/air mixture tends to knock less. In charged internal combustion engines, the cooling effect of the water injection becomes noticeable particularly advantageously.

In order to avoid pre-ignitions and knocking in the case of full loads, the fuel/air mixture is enriched (lambda<1). Here, the vaporization enthalpy of the fuel is utilized to cool the combustion chamber and to reduce the combustion temperatures. At the same time, the ignition angle is shifted toward retard thus resulting in a retarded center of combustion and thereby also in a worse efficiency. In the case of a full load, the water injection can therefore be used particularly advantageously.

One of the challenges in systems using water injection is the risk of freezing and thus improper operation at low outdoor temperatures. For this reason, the used components must be ice pressure-proof or the water supply system must be permanently heated at below-zero temperatures. Another option would be to always empty the water supply system when the vehicle is turned off, which, however, results in a considerable additional systemic complexity.

SUMMARY

An object of the present invention is to implement a water injection at least for certain areas of operation of an internal combustion engine which is implementable more cost-effectively and still works reliably.

According to an example embodiment, a method includes using at least one intake manifold injector for both the water injection and the fuel injection into the intake manifold (referred to in the following as intake manifold injection). Cost-effective and efficient water injections can thus be implemented in different ways. In known systems using cylinder-individual water injection into the intake port and cylinder-individual PDI (port/direct injection; a combination of intake manifold injection and gasoline direct injection), twelve injectors are needed in the case of a four cylinder engine, i.e., four water injectors, four PFIs (port fuel injectors, i.e., intake manifold injectors), and four DIs (direct injectors). According to the present invention, the four water injectors can now be dispensed with.

One possibility of implementing this object provides for connecting the low-pressure circuits of the water and fuel supply systems. For this purpose, a mixing valve without a return line can be connected, for example, directly upstream from the low-pressure accumulator for the intake manifold injectors.

According to another example embodiment, it can be provided to dispense with the mixing valve. In this case, it can be decided via the pressure control of the gasoline pump and the water pump, whether water or fuel should be metered via the Intake manifold injection.

By using only one intake manifold injector or cylinder inlet valve for both water injection and fuel injection, the water present in the fuel system, the low-pressure accumulator, and the injectors can be flushed out with the aid of the measures described below, thus eliminating the risk of freezing. The present invention allows for the use of a single injector for multiple cylinders as well as an injector which is provided for each individual cylinder and is used for both water injection and fuel injection.

The port fuel injection (PFI) is preferably used in the partial load range of the internal combustion engine, since the mixture turns out more homogeneous as compared to direct injection (DI) due to the longer mixture formation path, thus resulting in a reduced particle formation. It is particularly advantageous when the water injection is used at least in the full-load range of the internal combustion engine, since the knocking tendency is reduced in this case due to the cooling effect and the ignition angle can be further shifted toward "early." This results in an optimized center of combustion. Furthermore, an enrichment of the fuel mixture can be dispensed with or at least reduced under these conditions for the sake of component protection. Overall, this results in an increase in efficiency and/or in a reduced fuel consumption when operating the internal combustion engine in the full-load range.

Water is preferably injected under low pressure into the intake manifold or the cylinder intake port. This results in advantages with regard to the cost-benefit ratio as well as the robustness and thus the reliability of the overall system as compared to a water injection under high pressure into the cylinder or the combustion chamber.

Overall, the system according to the present invention is implementable cost-effectively, since the water injectors provided thus far are dispensed with. Moreover, the installation space is reduced. Furthermore, an anti-freeze function is implementable, since the injectors are flushable using fuel.

Since the two operating modes "water injection" and "intake manifold injection" do not necessarily overlap or overlap only slightly in the engine operating map of the internal combustion engine, an intake manifold valve or a cylinder inlet valve can be used for both media, gasoline and water. This can be implemented with the aid of a so-called 3/2-way valve or a mixing valve, for example directly at the low-pressure accumulator or at the low-pressure distributor. In this way, additional cylinder-individual water injectors can be dispensed with.

In applications in which an overlapping of the intake manifold injection and the water injection is not provided, the 3/2-way valve can be used. For example, the 3/2-way valve can then be set to water injection in the operating mode in which the fuel is metered only via gasoline direct injection, i.e., for example in the full-load range, so that 100% water is injected via the intake manifold or the cylinder inlet valve. During the partial-load operation, the 3/2-way valve can be set to fuel supply, so that 100% fuel and 0% water are injected via the intake manifold or the cylinder inlet valve.

Alternatively, the mixing valve or the switching valve can be completely dispensed with in the low-pressure circuit. Instead, it can be set via a pressure control of the water pump and of the low-pressure gasoline pump, preferably in combination with check valves or electrically controlled valves, whether water or fuel is injected. If the PFI injector is to inject only water, the water pump and/or the low-pressure gasoline pump can be controlled in such a way that the water pressure level is above the fuel pressure level to a sufficient extent, so that the check valve closes on the fuel side and only water is guided into the PFI system.

If, however, only fuel is to be metered via the PFI injector, the water pump and/or the low-pressure gasoline pump are controlled in such a way that the water pressure level is below the fuel pressure level to a sufficient extent. For example, the water pump can be completely deactivated in this case. These measures are taken to close the check valve on the water side and to guide only fuel into the PFI system. Alternatively to using check valves, correspondingly controlled electrical valves can also be used.

In a so-called split operation in which fuel is metered via the intake manifold injection as well as via the direct injection, a mixing valve can be used which connects the fuel low-pressure circuit to the water low-pressure circuit, so that a water/fuel mixture, whose mixing ratio is a function of the position of the mixing valve as well as of the water and fuel pressure, can be injected via the intake manifold valve or the cylinder inlet valve. This has the advantage that the water injection is also employable in operating ranges in which an overlapping of the intake manifold injection and the direct injection is provided. A water injection is then also possible in the case of a split operation.

The control of the mixing valve can be supplemented by a regulation, in particular in the case of mixing valves which are not settable sufficiently precisely. For this purpose, the lambda signal of the lambda sensor can be used as the regulator input signal variable. If the fuel portion is higher than expected, an excessively rich fuel/air mixture is detected. In this case, the mixing valve is subsequently controlled to promote a higher water portion. If the fuel portion is lower than expected, the mixing valve is subsequently controlled to promote a lower water portion. To ensure that neither water nor fuel enter each other's supply circuit, check valves are preferably connected upstream from the mixing valve inputs.

Supply systems without return lines or demand-controlled supply systems are advantageously used in the low-pressure range of water and fuel in order to prevent the fuel/water mixtures (emulsions) from entering the fuel tank and/or the water tank as well as other parts of the particular supply system.

In particular, in applications in which the water injection takes place only in the full-load range of the internal combustion engine, it can be provided that, when no longer in this operating range, a potentially present 3/2-way valve is adjusted in such a way that up to 100% fuel is metered via the intake manifold injection, so that the water is consumed from the low-pressure accumulator via the intake manifold injectors as a result of the intake manifold injections following thereafter. If neither a mixing nor a switching valve is provided, the water pressure can be reduced in the manner described above, so that only fuel enters the low-pressure accumulator and is metered via the intake manifold injectors.

If the internal combustion engine is operated in the intake manifold injection/direct injection split operation (PFI/DI split operation) after terminating the water injection, the fuel portion metered via the intake manifold injection can be increased up to 100%, so that the water can be removed more rapidly from the low-pressure accumulator via the PFI injectors due to the increased PFI quantity. How long these measures for displacing the water from the fuel low-pressure accumulator (so-called water emptying function) are necessary can be determined with the aid of a software model. This software model ascertains the fuel quantity already injected and/or the water quantity still present in the low-pressure accumulator.

Since it is not common to turn off the internal combustion engine during full load operation, i.e., at a high torque and high rotational speed, because the internal combustion engine generally runs through the operating range toward the partial load range and then toward the idle speed prior to being turned off, it can be ensured that the water is emptied which is still present in the low-pressure accumulator after a water injection has taken place. If, however, a start/stop function or a coasting function is provided, it can occur that the internal combustion engine is actively turned off by the engine control unit without initially ensuring that all the water is emptied from the low-pressure accumulator. In this case, it can be provided to suppress the start/stop operation until the water in the low-pressure accumulator has been completely replaced by fuel.

When computing the control duration of the PFI injectors, the water/fuel ratio instantaneously present in the low-pressure accumulator is preferably taken into account in order to implement the required engine torque. For example, the greater the water portion is in the water/fuel mixture, the longer the control duration is selected to be in order to constitute the necessary fuel quantity to be metered via the intake manifold injection. The missing portion of the fuel quantity is preferably metered via the direct injection in particular as long as only water or an insufficient fuel quantity is injected via the intake manifold injection. In this way, it can be ensured at any point in time that the optimal or necessary fuel quantity is meterable.

After terminating a water injection, the water content in the fuel/water mixture is preferably determined in order to establish whether and using what parameters the water emptying function should be activated. For determining the water content, it can be provided to meter the fuel initially only via the direct injection. In a state in which lambda is adjusted, the intake manifold injection can be temporarily connected, however without a normally occurring adjustment of the resulting split operation. It can be determined, as a function of the lambda signal measured during this operating mode, whether this measure results in an enrichment and how strong same is. It can be detected as a function of the degree of the enrichment how large the water portion and/or the fuel portion is in the fuel/water mixture which is metered via the intake manifold injection. As soon as the lambda value coincides with a corresponding enrichment value of an intake manifold injection carried out without water injection, which is determinable, for example, via a characteristic curve or a characteristic map, the state "water emptied" is detected.

The water emptying function thus ensures that no more water remains, which could freeze at below-zero temperatures, in the low-pressure accumulator or the PFI injectors when the internal combustion engine is turned off. Complex methods, such as sucking or pumping the water back, or other complex ice pressure-proof designs of the individual components can thus be dispensed with.

Specific embodiments which are improved even further in their function can include a so-called water-filling function with the aid of which it is ensured that a water portion necessary for a water injection to be carried out is preferably available in an expedited manner. Namely, if in the case of an abrupt load jump toward full load, an excessively low water portion or exclusively fuel is present in the low-pressure accumulator of the intake manifold injection system, the ignition angle can be displaced only disproportionately slowly as a function of the incrementally increasing water portion toward the optimal, early ignition angle in order to avoid knocking effects. Various measures can be taken, to take into account the excessively low injected water quantity with regard to the efficiency of shifting the ignition angle forward in this transition state, on the one hand, and to ensure that knocking does not occur, on the other hand.

According to an example embodiment, a pilot control takes place as a function of a model until the desirable water portion or the desirable water/fuel ratio is obtained in the low-pressure rail. For example, the fuel quantity present between the 3/2-way valve or the mixing valve and the PFI injector as well as its displacement point in time by water is ascertained from the geometry of the fuel lines and of the low-pressure accumulator, the position of the 3/2-way valve, the already injected PFI quantity, the instantaneous PFI quantity, and/or the instantaneous fuel pressure. At this point in time, the ignition angle can be shifted completely to early.

Alternatively or additionally, a changing, increasing water concentration can be taken into account incrementally and continuously.

Another possibility provides for detecting, as a function of a signal of the knock sensor, whether a sufficient quantity of water is already present in the PFI supply system, since the knocking tendency is reduced with increasing water portion. It can, for example, be provided to shift the ignition angle forward if required by the full load. If the knocking control then detects a knocking of the internal combustion engine, the fuel portion present in the PFI system is still excessively high, so that the ignition angle is pulled back again as far as necessary in this transition state.

It can also be provided to detect via the lambda signal, whether a sufficient quantity is already present in the PFI supply system. If the internal combustion engine is, for example, operated in the PDI split operation, i.e., in which a portion of the fuel mixture is metered via the direct injection and another portion is metered via the intake manifold injection, it can be detected due to a temporary abrupt increase in the fuel quantity metered via the intake manifold injection with the aid of the lambda signal, whether an enrichment takes place and how strong same is, the temporary increase in the PFI quantity naturally not being taken into account when controlling/regulating the split operation. It can then be detected as a function of the thus detected lambda signal how large the water portion and/or the fuel portion is in the fuel/water mixture which is metered via the intake manifold injection. This takes place similarly to the above-described method for the water emptying function, for example via appropriate characteristic curves and/or characteristic maps, or other models. This can also take place cylinder-individually, i.e., in individual cylinders and, potentially, alternatingly.

Moreover, it can be provided to increase at the beginning of a water injection, for example after a full-load requirement, in the transition state the portion of the fuel metered via the intake manifold injection and to reduce in this transition state the portion metered via the direct injection. In this way, the PFI supply system is filled with water faster, i.e., the fuel/water mixture is shifted faster toward water, thus allowing for the ignition angle to be shifted forward faster which, in turn, results in an improved dynamic in the case of load changes.

Further features, possible applications and advantages of the present invention result from the following description of exemplary embodiments which are explained with reference to the drawings. The described features can be implemented individually and in different combinations without explicit reference being made thereto.

DETAILED DESCRIPTION

Figure 1:
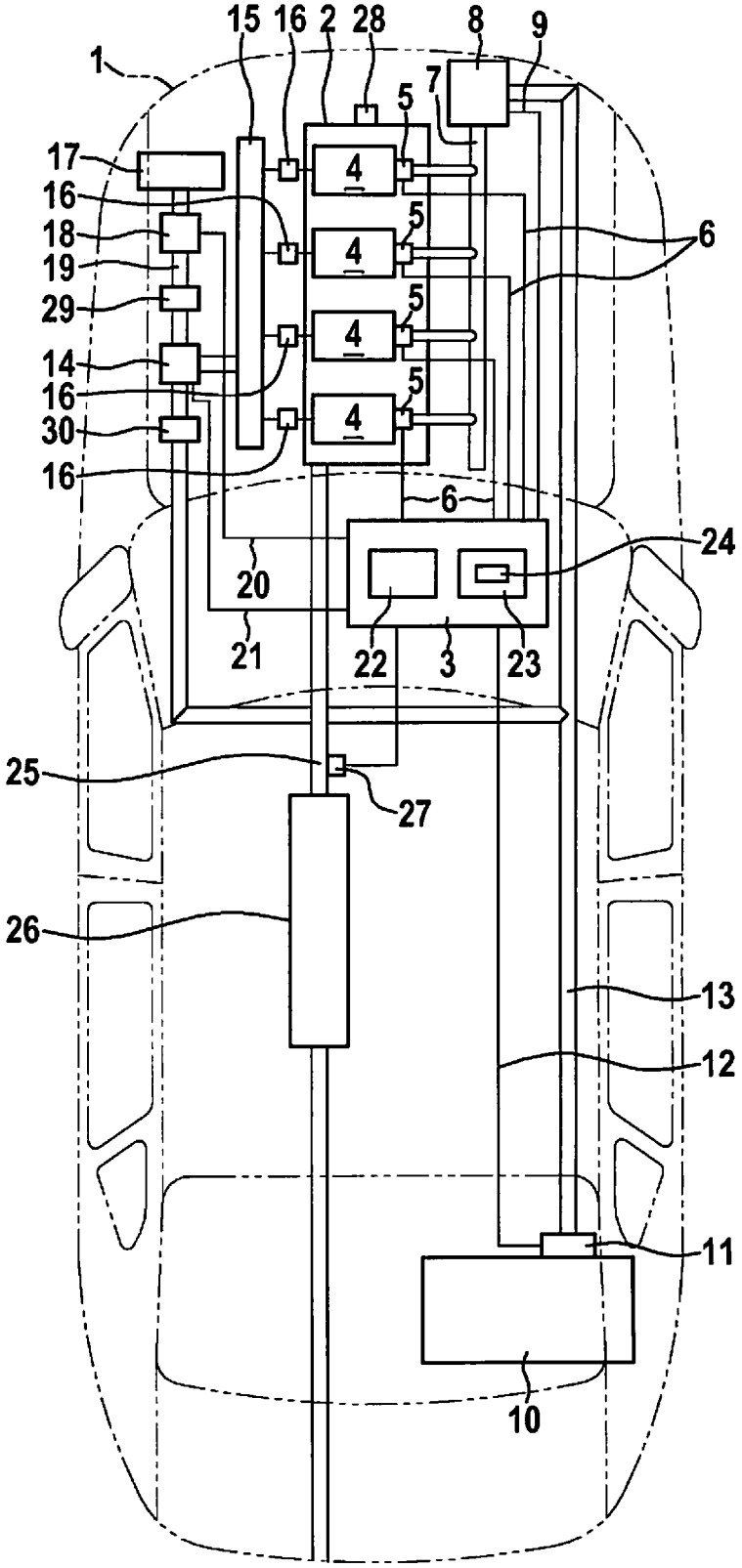
FIG. 1 is a schematic representation of an internal combustion engine that is operable with a gasoline direct injection, an intake manifold fuel injection, and a water injection, according to an example embodiment of the present invention.

A vehicle 1 that includes an internal combustion engine 2 for driving vehicle 1 is schematically illustrated in FIG. 1. In vehicle 1, a control unit 3 is situated which enables a control and/or regulation of internal combustion engine 2 and, in particular, a control of the mixture formation. Internal combustion engine 2 includes cylinders 4. Each cylinder 4 is assigned at least one direct injector 5. Each direct injector 5 is connected to control unit 3 via a signal line 6.

Direct injectors 5 are connected to a fuel high-pressure pump 8 via a high-pressure accumulator 7 (high-pressure rail). Fuel high-pressure pump 8 is connected to control unit 3 via a data line 9.

A fuel tank 10 which is assigned a fuel low-pressure pump 11 is further shown in FIG. 1. Fuel low-pressure pump 11 is connected to control unit 3 via a data line 12.

The fuel supplied by fuel low-pressure pump 11 from fuel tank 10 reaches fuel high-pressure pump 8, which generates the pressure necessary for the gasoline direct injection, via a fuel low-pressure line 13. In the exemplary embodiment shown in FIG. 1, fuel low-pressure pump 11 moreover makes available the pressure necessary for the intake manifold injection. For this purpose, the fuel reaches a fuel low-pressure accumulator 15 (fuel low-pressure rail) via fuel low-pressure line 13 and a valve 14 which can be designed as a 3/2-way valve or as a mixing valve. Fuel low-pressure accumulator 15 is connected to intake manifold injectors 16 (PFI injectors).

In FIG. 1, a water injection system is further shown which includes a water tank 17 and an electric water pump 18 connected to valve 14 via a line 19. Electric water pump 18 and valve 14 are connected to control unit 3 via data lines 20 and 21. The example embodiment shown in FIG. 1 further includes check valves 29 and 30 which are situated in the water low-pressure circuit and the fuel low-pressure circuit.

Control unit 3 includes a processor 22 and a memory element 23. In memory element 23, a computer program 24 is stored, for example, which is programmed to carry out the method according to the present invention. The method according to the present invention is then carried out with the aid of control unit 3 when computer program 24 runs on processor 22.

Internal combustion engine 2 is connected to an exhaust tract 25 which includes an exhaust gas catalytic converter 26 and a lambda sensor 27. Internal combustion engine 2 is further assigned a knock sensor 28.

Figure 2:
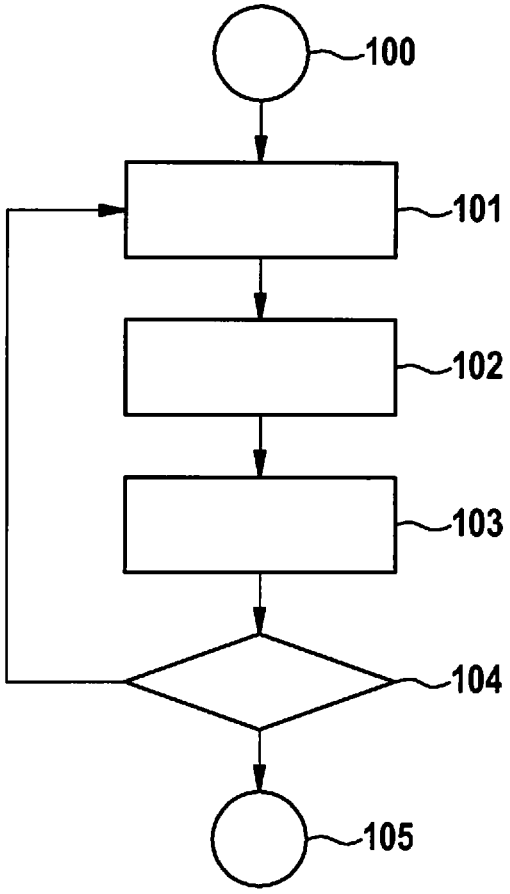
FIG. 2 is a flowchart including possible method steps for flushing out injectors according to an example embodiment of the present invention.

FIG. 2 is a flowchart of steps that take into account the water portion present in the fuel low-pressure accumulator 15 following a water injection that took place for the further operation of the internal combustion engine.

In a step 100, the water injection is terminated. This can be the case, for example, when an instantaneous performance requirement leaves the full-load range. In a step 101, the water portion which is still present in fuel low-pressure accumulator 15 is flushed out. For this purpose, valve 14 is adjusted in such a way that up to 100% fuel is metered via the intake manifold injection. As a result, the water which is still present in the intake manifold injection system is consumed particularly quickly. If the vehicle is in a DI/PFI split operation, the portion of the intake manifold injection (PFI) can be adjusted to up to 100%. In systems in which no valve 14, i.e., neither a mixing nor a switching valve, is present, the water pressure can be alternatively reduced by appropriately controlling electric water pump 18, so that only fuel is delivered into the low-pressure accumulator.

In a step 102, the water portion present in the low-pressure accumulator is determined to ascertain how long the water emptying function should be active. This preferably takes place by using a software model. This software model computes the fuel quantity already injected and uses same to ascertain the quantity of water which is still present in the low-pressure accumulator.

In a step 103, the internal combustion engine is operated taking into account the water portion still present in the low-pressure accumulator.

In a step 104, it is checked whether water is still present in the low-pressure accumulator. If this is the case, the internal combustion engine is continued to be operated in such a way that a flushing is achieved preferably rapidly and the water portion is taken into account during the operation of the internal combustion engine. If there is no more water in the fuel low-pressure accumulator or if the water portion is below a certain minimal threshold value, the process returns to a normal operation of the internal combustion engine in a step 105.

Figure 3:
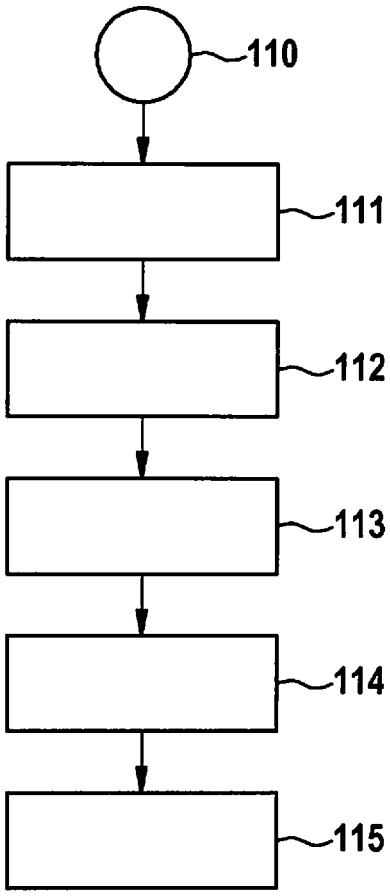
FIG. 3 is a flowchart including several method steps for determining the water portion in the gasoline/water mixture in the low-pressure accumulator according to an example embodiment of the present invention.

In FIG. 3, method steps are shown which make it possible to determine the water portion in the fuel/water mixture, for example to determine the water portion in the low-pressure accumulator (step 103 in FIG. 2) or to carry out a diagnosis of the overall system. The method starts in a step 110 in which the water portion is to be determined. In a step 111, the internal combustion engine is operated only via the direct injection. In a step 112, the intake manifold injection is temporarily connected, however without adjusting this fuel metering as is usually the case in the DI/PFI split operation. Instead, in a step 113, the lambda signal is detected and evaluated by lambda sensor 27. The evaluation initially shows whether there is an enrichment and/or how strong same is due to the temporary connection of the intake manifold injection. The degree of the enrichment can then be used to determine the water portion and/or the fuel portion in the fuel/water mixture which was metered via the intake manifold injection. This evaluation takes place in a step 114. Here, the lambda value can be compared to a corresponding enrichment value of an intake manifold injection without a preceding water injection. If the measured lambda value matches this enrichment value, a water portion ascertained in a method step 115 can be determined as "zero" and the state of the system may be detected as "water emptied."

Figure 4:
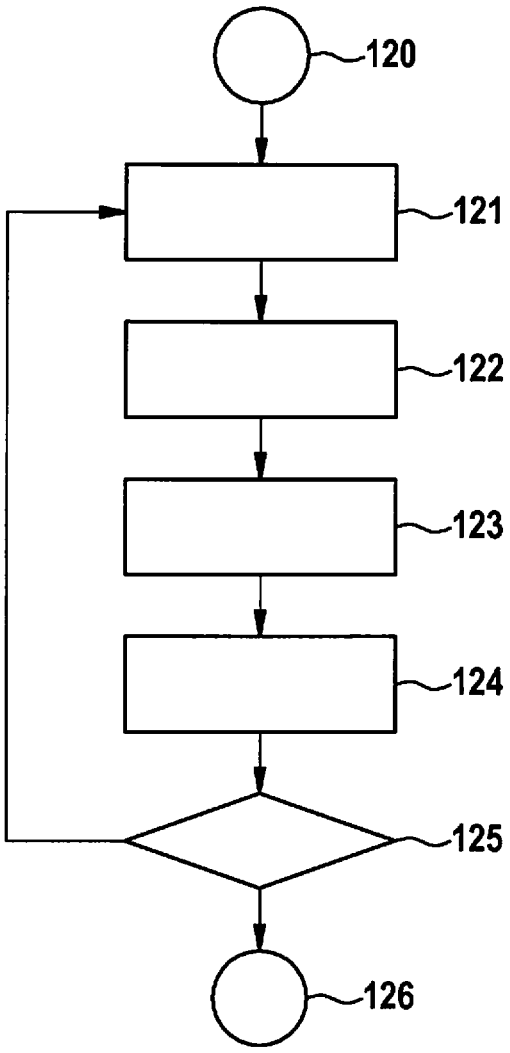
FIG. 4 is a flowchart including method steps that can be carried out at the beginning of the water injection in order to obtain a rapid response of the overall system according to an example embodiment of the present invention.

FIG. 4 shows method steps which can be carried out when a "water filling function" is carried out during which the water is to displace the fuel present in the fuel supply system in fuel low-pressure accumulator 15 preferably rapidly.

In general, the ignition angle can only be shifted as a function of the incrementally increasing water portion toward "early" to the optimal ignition angle for this operation in the case of the activation of the water injection due to the load jump toward full load and in the case of an excessively low water portion or a state in which only fuel is present in the low-pressure accumulator, as otherwise knocking effects would occur. Various measures or combinations thereof can be implemented to already take into account the excessively low injected water quantity with regard to the efficiency of shifting the ignition angle forward in this transition state, on the one hand, and to prevent knocking, on the other hand. Different embodiments and refinements of this functionality are explained based on the flowchart shown in FIG. 4.

In a step 120, the water filling function is activated. According to an example embodiment, the instantaneous water portion in the fuel low-pressure system is determined in a step 121. This can take place, for example, through the evaluation of a knock signal by knock sensor 28. Alternatively and/or additionally, the changing increasing water portion can be determined in step 121 from a model or incrementally continuously taken into account when metering the fuel. Alternatively or additionally, a diagnosis can be carried out in steps 122, 123, and 124 in order to establish whether a sufficient quantity of water is already present in the intake manifold supply system. For example, the water quantity present in low-pressure accumulator 15 can be determined by evaluating the lambda signal. For this purpose, the fuel quantity metered via the intake manifold injection is temporarily increased in step 122. In step 123, the degree of the enrichment is ascertained based on the lambda signal. In step 124, the water portion present in low-pressure accumulator 15 is inferred from the degree of the enrichment. This occurs similarly to the diagnostic procedure described in FIG. 3.

According to an example embodiment, the portion of the fuel metered via the intake manifold injection was increased in step 121 for the purpose of preferably rapidly increasing the water portion metered via the intake manifold injection. It can be provided to check in a step 125, whether the water portion has reached the maximum value. If this is the case, the ignition angle is set to "early" in a step 126, which is the ignition angle provided for the optimal quantity of injected water. According to another example embodiment, the ignition angle is successively shifted to early depending on the instantaneous water/fuel ratio in the low-pressure accumulator or the increase of the water portion in the low-pressure accumulator.

It can be achieved with the aid of the method described in FIG. 4 that the maximum advantages of the supplementing water injection, in particular in the case of an operation under full-load conditions, can be used preferably rapidly, since on the one hand, a rapid and controlled filling of the low-pressure accumulator with water after an activated water injection is possible and, on the other hand, the delayed filling of the low-pressure accumulator with water is taken into account when adjusting the ignition angle to "early."

What is claimed is:

1. A method for operating an internal combustion engine that is arranged for receiving both direct and intake manifold injections, the method comprising:

using a same intake manifold injector, injecting water and fuel into the internal combustion engine as part of the intake manifold injection;

wherein, after terminating an operating mode in which the water injection takes place, the fuel is metered via the intake manifold injector such that water present in a low-pressure accumulator, which is used for both the water injection and the fuel injection, is consumed.

2. The method of claim 1, wherein a duration of an activation of the fuel injection is determined as a function of a PFI portion in a split operation and a quantity of water still present in the low-pressure accumulator when the fuel injection is performed.

3. The method of claim 1, further comprising executing at least one of a start/stop function and a coasting function by which a stop of the internal combustion engine is prevented until the water present in the low-pressure accumulator is consumed.

4. The method of claim 1, wherein, after terminating an operating mode in which the water injection takes place, the injection of the fuel is controlled based on a quantity of water still present in a low-pressure accumulator.

5. The method of claim 1, further comprising:

operating the internal combustion engine using the direct injection and an adjusted lambda value;

connecting the intake manifold injector for the intake manifold injection;

determining a resultant enrichment of an overall mixture by evaluating a lambda signal;

determining at least one of a water portion and a fuel portion in a water/fuel mixture to be metered via the intake manifold injector.

6. The method of claim 1, further comprising:

operating the internal combustion engine using the direct injection and an adjusted lambda value;

connecting the intake manifold injector for the intake manifold injection;

comparing a lambda signal representing a resultant enrichment of an overall mixture to an enrichment value that corresponds to an intake manifold injection; and detecting that no water is present in the low-pressure accumulator when the lambda signal matches the enrichment value.

7. The method of claim 1, further comprising, during or after activating the water injection, determining at least one of when and what extent a change in an ignition angle takes place.

8. The method of claim 7, wherein the determination is based on at least one of a geometry of a fuel line via which the fuel is fed to the intake manifold injector, a geometry of a low-pressure accumulator via which the fuel and the water are fed to the intake manifold injector, a fluid quantity injected via the intake manifold injection, an instantaneous fuel pressure, an instantaneous position of a valve that controls respective quantities of the fuel and the water fed to the intake manifold injector, a control of a water pump that pumps the water to the intake manifold injector, and a control of a fuel pump that pumps the fuel to the intake manifold injector.

9. The method of claim 1, further comprising detecting a knock sensor signal following an activation of the water injection and determining, based on the detected knock sensor signal, whether a sufficient quantity of water is meterable via the intake manifold injection.

10. The method of claim 1, further comprising, during or after activating the water injection and operating the internal combustion engine in an operation in which both the intake manifold injection and the direct injection take place:

temporarily increasing a portion of the fuel metered via the intake manifold injection;

determining a resultant enrichment of an overall mixture of the water and fuel by evaluating a lambda signal;

based on the determined resultant enrichment, determining a modification of the portion of the fuel and a portion of the water in the overall mixture to be metered via the intake manifold injection.

11. The method of claim 1, wherein a portion of the fuel metered via the intake manifold injection is increased during or after activating the water injection and operating the internal combustion engine in a mode in which both the intake manifold injection and the direct injection occur.

12. The method of claim 11, further comprising:

using a software model, computing the respective portions of the fuel and of the water present in a rail; and based on the computed portions, determining when an increase in the fuel portion metered via the intake manifold injection is to be terminated.

13. The method of claim 1, wherein the water injection occurs in a full-load range.

14. The method of claim 1, wherein, in the water injection, the water is injected under low pressure.

15. The method of claim 1, wherein, using a mixing or 3/2-way valve that is arranged in low-pressure circuits of a source of the water and of a source of the fuel, a switchover takes place between at least two of the injection of the water, the injection of the fuel, and a mix of the injection of the water and the fuel.

16. The method of claim 15, wherein:

the valve is a mixing valve;

the method further comprises, based on a signal of a lambda sensor, controlling the mixing valve to form a mixture of the water and the fuel; and the injecting of the water and the fuel includes metering the mixture via the intake manifold injector.

17. The method of claim 1, wherein a respective check valve is situated in each of a low-pressure circuit of a source of the fuel and a low-pressure circuit of a source of the water injection, upstream from at least one of (a) a shared fuel low-pressure line to which both the water and the fuel are fed and (b) respective inputs to a shared valve.

18. The method of claim 17, further comprising controlling whether the water is guided into the intake manifold injector using a water pump and controlling whether the fuel is guided into the intake manifold injector using a low-pressure gasoline pump.

19. The method of claim 1, wherein supply systems for metering the fuel and the water in a low-pressure range are demand-controlled.

20. A fuel metering system for an internal combustion engine, the system comprising:

a direct fuel injector via which a direct fuel injection into the internal combustion engine can be performed;

a water source;

a fuel source;

an intake manifold injector to which water is suppliable from the water source and fuel is suppliable from the fuel source for an injection of water and fuel into the internal combustion engine via the intake manifold injector;

wherein, after terminating an operating mode in which the water injection takes place, the intake manifold injector is configured to meter the fuel such that water present in a low-pressure accumulator, which is used for both the water injection and the fuel injection, is consumed.

21. A control unit for operating an internal combustion engine that is arranged for receiving both direct and intake manifold injections, the control unit comprising:

a processor coupled to a metering circuit and that is configured to control the metering circuit to inject water and fuel into the internal combustion engine as part of the intake manifold injection using a same intake manifold injector of the metering circuit;

wherein, after terminating an operating mode in which the water injection takes place, the processor is configured to meter the fuel via the intake manifold injector such that water present in a low-pressure accumulator, which is used for both the water injection and the fuel injection, is consumed.

* * * * *